US005546172A

United States Patent [19]

Seto

[11] Patent Number: 5,546,172

[45] Date of Patent: Aug. 13, 1996

[54] TRANSFER OMISSION DETECTOR IN TRANFER UNIT FOR IMAGE FORMING APPARATUS

[75] Inventor: Fumiaki Seto, Kawasaki, Japan

[73] Assignee: Fujitsu Limited, Kanagawa, Japan

[21] Appl. No.: 289,854

[22] Filed: Aug. 12, 1994

[30] Foreign Application Priority Data

Nov. 19, 1993 [JP] Japan ..... 5-290306

[51] Int. Cl.[6] ..... G03G 15/00

[52] U.S. Cl. ..... 355/274; 355/208; 355/276

[58] Field of Search ..... 355/276, 274, 355/271, 272, 273, 275, 277, 208, 207; 347/137, 140

[56] References Cited

U.S. PATENT DOCUMENTS

| | | | |
|---|---|---|---|
| 4,772,918 | 9/1988 | Karasawa et al. | 355/274 |
| 4,797,705 | 1/1989 | Nishioka | 355/207 |
| 4,890,125 | 12/1989 | Egawa et al. | 347/137 |
| 5,155,501 | 10/1992 | Fujita et al. | 355/246 X |
| 5,278,613 | 1/1994 | Bisaiji et al. | 355/208 |
| 5,287,144 | 2/1994 | Takeda | 355/208 |

FOREIGN PATENT DOCUMENTS

| | | | |
|---|---|---|---|
| 3444554 | 6/1986 | Germany . | |
| 3837528 | 5/1989 | Germany . | |
| 3908488 | 9/1989 | Germany . | |
| 4316287 | 11/1993 | Germany . | |
| 63-10167 | 1/1988 | Japan . | |
| 1-123267 | 5/1989 | Japan . | |
| 1-234874 | 9/1989 | Japan . | |
| 1-234860 | 9/1989 | Japan . | |
| 1-139247 | 9/1989 | Japan . | |
| 3248182 | 11/1991 | Japan | 355/274 |
| 6-43726 | 2/1994 | Japan . | |
| 6-27757 | 2/1994 | Japan . | |
| 6-143699 | 5/1994 | Japan . | |

*Primary Examiner*—Thu Anh Dang

[57] ABSTRACT

When a transfer is to be performed, a setting device sets a transfer voltage value VTC, which is that at which optimum transfer is obtained, as well as a transfer assuring voltage value VAC which assures transfer. A constant-current source performs constant-current control in such a manner that the transfer voltage having the set value is applied to a transfer corona discharge device so that a constant transfer current $I_T$ will flow. As a result, the transfer corona discharge device charges printing paper to a polarity opposite that of the electric charge of toner by corona discharge, thereby transferring the toner image to the paper. A voltage detector detects a voltage $V_T$ applied to the transfer corona discharge device, and a comparator compares the detected voltage $V_T$ with the transfer assuring voltage $V_A$. If the detected voltage $V_T$ is less than the transfer assuring voltage $V_A$, then the comparator takes this as meaning that transfer omission has occurred, as the result of a discharge abnormality such as leakage, and issues an alarm ALM1.

6 Claims, 12 Drawing Sheets

PROCESS CONTROLLER
40
DATA
ADDRESS
CONTROL PANEL
110
ALM1
VTC
VAC
TD
VTOC
CONSTANT-CURRENT SOURCE
50
50a
Reg
R
50b
D/A
50c
Amp
VTin
50d CONSTANT-CURRENT CIRCUIT
I
TRANSFER ASSURING VOLTAGE GENERATOR
70
70a
70b
70c
VA
VOLTAGE DETECTOR
60
30
VT
iT
R1
R2
LEADING-EDGE DETECTOR
80
80a
80b
80c
CMP
VT'
LGS
LDS
FF
C
J
K
R
CLK
90
90a
90b
90c
90d
90e
MPK
CLK1
CLK2
CLK3
OSC1
OSC2
OSC3
ENS
RST
130

FIG. 14 (PRIOR ART)
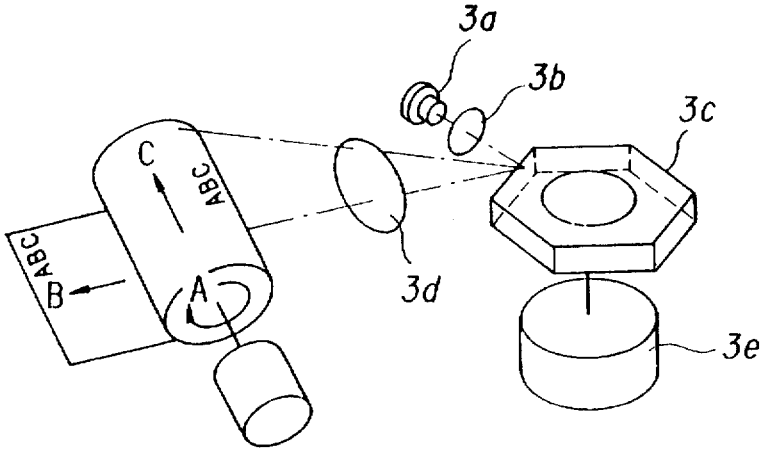
FIG. 15A (PRIOR ART)
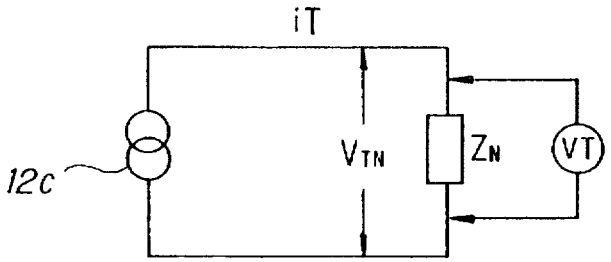
FIG. 15B (PRIOR ART)
| | SHORT CIRCUIT | LEAKAGE | NORMAL |
|---|---|---|---|
| IMPEDANCE Z | $Z_S$ | $Z_L$ | $Z_N$ |
| $V_T$ | $V_{TS}$ $(=i_T \cdot Z_S)$ | $V_{TL}$ $(=i_T \cdot Z_L)$ | $V_{TN}$ $(=i_T \cdot Z_N)$ |

TRANSFER OMISSION DETECTOR IN TRANFER UNIT FOR IMAGE FORMING APPARATUS

BACKGROUND OF THE INVENTION

This invention relates to a transfer unit and an image forming apparatus using the transfer unit. More particularly, the invention relates to a transfer unit for forming an image on a recording carrier by a transfer material (toner), charging a transfer medium (paper) to a polarity opposite that of a charge on the transfer material by a corona discharge and transferring the transfer material to the transfer medium, as well as to an image forming apparatus using this transfer unit.

In a recording apparatus such as an electrophotographic printer, an optical image is projected upon a photosensitive drum to form an electrostatic latent image on the photosensitive drum, the electrostatic latent image is then developed into a toner image and the toner image is transferred to paper, whereby the image is printed.

FIG. 13 is a diagram showing the overall construction of an electrophotographic printer which uses laser light as the exposing light source. The printer includes a photosensitive drum 1 having a photoconductor (photoreceptor) on the surface thereof. The drum 1 is rotated in the direction of arrow A at a constant speed. The printer further includes a primary corona discharge device 2 for uniformly charging the surface of the photosensitive drum 1, an exposure optical unit 3 for irradiating the photosensitive drum 1 with an optical image to form an electrostatic latent image, a developing unit 4 for forming a toner image corresponding to the electrostatic latent image and having a toner supply section 4*a* and a developing section 4*b*, a transfer corona discharge device 5 for transferring the toner image to printing paper CP, an optical charge removing device 6 for irradiating the photosensitive drum with light to remove electric charge from the drum, a cleaner 7 having a brush 7*a* and a blade 7*b* for removing and wiping off toner remaining on the photosensitive drum, rollers 8, 9 for conveying the paper, and a fixing unit 10, constituted by a thermal fixing roller 10*a* or the like, for fixing the toner that has been transferred to the paper.

A detector 11 detects the printing paper CP. A high-voltage power supply 12 is equipped with a power supply section 12*a* for generating a corona discharge by applying a voltage $V_C$ to the primary corona discharge device 2, a power supply section 12*b* for charging the toner to a prescribed polarity by applying a developing bias voltage $V_B$ to a magnet roll (developing roll) of the developing section 4*b*, and a power supply section (constant-current source) for generating a corona discharge by applying a transfer voltage VT to the transfer corona discharge device 5. The paper CP, which is delivered one sheet at a time from a hopper (not shown) on the right side of the drawing, is conveyed in the direction of arrow B and is discharged into a stacker (not shown) on the left side of the drawing via the transfer discharge device 5 and fixing unit 10.

When the optical image is projected upon the surface of the photosensitive drum 1 uniformly charged to a positive charge, for example, by the primary corona discharge device 2, the potential at portions upon which the light is incident drops so that an electrostatic latent image is formed. Next, the magnet roll MGR biased at the prescribed developing voltage VB is rotated in the developing unit 4 so as to rub the positively charged toner against the surface of the photosensitive drum, whereupon the toner is dispersed over the electrostatic latent image to form a toner image. If the transfer corona discharge device 5 subsequently generates a corona discharge from the bottom side of the paper CP at a potential whose polarity (minus) is opposite the potential to which the toner image has been charged, the paper is charged negatively. As a result, the toner image is attracted to the paper CP and transferred thereto. The paper CP to which the toner image has been transferred by the transfer corona discharge device 5 is conveyed to the fixing unit 10. Here the paper CP is subjected to thermal fixing before being discharged into the stacker (not shown) on the left side of the drawing. After the toner image has been transferred to the paper, the photosensitive drum 1 is rotated further, charge is removed by the optical charge removing device 6 and residual toner is removed by the cleaner 7 to prepare for formation of the next electrostatic latent image. It should be noted that timing for starting and ending projection of the optical image by the optical unit 3 and timing for starting and stopping the corona discharge performed by the transfer corona discharge device 5 is controlled by a controller (not shown) using as a reference the time at which the leading edge of the paper is detected by the detector 1. This assures that the paper will be printed on correctly.

FIG. 14 is a diagram showing the construction of the exposure optical unit 3. The unit includes a laser diode 3*a*, a collimating lens 3*b*, a polygon mirror 3*c* which causes a laser beam to scan the photosensitive drum 1 in the longitudinal direction (along the direction of arrow C), an F-θ lens (image forming lens) 3*d* and a spindle motor 3*e* for rotating the polygon mirror at a constant speed.

The laser light is on/off modulated by controlling the on/off action of a laser diode 3*a* based upon dot-image printing information. The laser light on/off-modulated by the printing information arrives at the polygon mirror 3*c* via the collimating lens 3*b*. Since the polygon mirror 3*c* is being rotated by the spindle motor 3*e* at a constant speed, the incident laser light is moved repeatedly in the longitudinal direction (along the direction of arrow C) of the photosensitive drum 1 via the F-θ lens 3*d*. Accordingly, if the laser light on/off-modulated by the printing information is made to scan longitudinally of the photosensitive drum 1 while the drum is rotated in the direction of arrow A, a dot optical image will be projected upon the surface of the photosensitive drum to form an electrostatic latent image in the form of dots on the drum surface.

With reference again to FIG. 13, the transfer corona discharge device 5 has a corona discharge wire 5*a* to which a high DC voltage on the order of −4—7 KV is applied so that a constant current will flow through it. As a consequence of this arrangement, there are occasions where leakage occurs between the discharge wire 5*a* and a chassis 5*b* of the corona discharge device 5 as well as between the discharge wire 5*a* and the photosensitive drum 1. Further, there are instances where electrically conductive foreign matter attaches itself to the discharge wire 5*a*, or where the wire 5*a* is contaminated or damaged, thus giving rise to leakage. When such leakage occurs, the impedance Z of the transfer corona discharge device 5 decreases.

When the transfer corona discharge device 5 is operating normally, the constant-current source 12*c* applies the high DC voltage $V_T$ ($=V_{TN}=i_T \cdot Z_N$) and control is performed in such a manner that a constant current $i_T$ will flow, as shown in FIG. 15A. When leakage occurs and the impedance drops from $Z_N$ to $Z_L$, therefore, the applied voltage falls to VTL ($=i_T \cdot Z_L$), as illustrated in FIG. 15B. When the applied voltage declines, the toner image that has been formed on the recording carrier, namely the photosensitive drum 1, is no longer transferred to the transfer medium or paper CP normally. Furthermore, in the event of a short circuit, the impedance Z declines further and the relation $VTS=(i_T \cdot Z_S)$ is established. This makes transfer impossible.

The prior art is devoid of effective means for detecting that transfer has been performed normally, i.e., for detecting that transfer has not been carried out normally (referred to as "transfer omission"). All that is provided is circuitry for protecting the constant-current source. Specifically, an overcurrent detecting circuit or overvoltage detecting circuit is provided. However, such circuitry includes a drive circuit for driving the constant-current source or a detecting circuit provided in order to protect the load (the transfer corona discharge device) from damage, and the relevant set values are made much higher than values which assure transfer. This means that transfer omission due to leakage cannot be detected.

Japanese Patent Application Laid-Open (KOKAI) No. 63-10167 discloses art in which an abnormality in the constant-current source used for the corona discharge of the transfer corona discharge device is detected by a fluctuation in the current value. That is, the power supply is judged to be abnormal when the transfer current which flows into the transfer corona discharge device fluctuates above a set value. Though power-supply abnormality can be detected with this known method, it is not possible to detect a discharge abnormality ascribable to leakage, i.e., transfer omission due to leakage. The reason is that even if the current which flows into the transfer corona discharge device varies slightly when discharge abnormality occurs owing to leakage, feedback is applied immediately and control is effected so as to render the current value constant. Holding the current value constant is the essence of the constant-current source.

Since transfer omission due to leakage thus cannot be detected immediately in the prior art, the occurrence of transfer omission is discovered by the user only after printing a number of sheets. This means that a large number of unsatisfactory copies may be produced. In other words, a problem encountered in the prior art is that even if transfer omission occurs, faulty printing is construed as being normal and unsatisfactory printout is performed.

Another problem is that detection of transfer omission due to leakage, namely detection of discharge abnormality, is delayed. This can lead to other abnormalities in the system.

Still another problem with the prior art is that even if unsatisfactory printing (transfer omission) is discovered, maintenance is troublesome because it is difficult to determine where the abnormality is occurring.

SUMMARY OF THE INVENTION

Accordingly, a first object of the present invention is to provide a transfer unit, as well as an image forming apparatus using this transfer unit, in which discharge abnormality due to leakage, namely transfer omission, can be detected automatically and a warning issued.

A second object of the present invention is to provide a transfer unit, as well as an image forming apparatus using this transfer unit, in which even if a value of transfer voltage or transfer current is altered to change transfer performance, transfer omission can be detected with certainty.

A third object of the present invention is to provide a transfer unit, as well as an image forming apparatus using this transfer unit, in which transfer-omission detection sensitivity can be altered based upon printing speed or the like.

In accordance with the present invention, the foregoing objects are attained by providing a transfer unit for forming an image on a recording carrier by a transfer material, charging a transfer medium to a polarity opposite that of a charge on the transfer material by a corona discharge and transferring the transfer material to the transfer medium, comprising a transfer corona discharge device for generating a corona discharge, a setting device for setting a transfer voltage or transfer current as well as a transfer assuring voltage for assuring transfer, a high-voltage generator, which is constituted by a constant-current source, for applying a transfer voltage, which has a value conforming to the set transfer voltage or transfer current, to the transfer corona discharge device, a voltage detector for detecting the voltage applied to the transfer corona discharge device, and a comparator for comparing the detected voltage and the transfer assuring voltage and generating an alarm when the detected voltage has become less than the transfer assuring voltage.

Further, the foregoing objects are attained by providing an image forming apparatus for forming a toner image on a photosensitive drum, charging a cut sheet of paper to a polarity opposite that of a charge on the toner by a corona discharge and transferring a toner image to the cut sheet of paper, comprising a preliminary corona discharge device for uniformly charging a surface of the photosensitive drum, an optical unit for projecting an optical image upon the photosensitive drum and forming an electrostatic latent image, a developing unit for forming a toner image corresponding to the electrostatic latent image, and a transfer unit for transferring the toner image to the cut sheet of paper, wherein the transfer unit includes a transfer corona discharge device for generating a corona discharge, a setting device for setting a transfer voltage or transfer current as well as a transfer assuring voltage for assuring transfer, a high-voltage generator, which is constituted by a constant-current source, for applying a transfer voltage, which has a value conforming to the set transfer voltage or transfer current, to the transfer corona discharge device, a voltage detector for detecting the voltage applied to the transfer corona discharge device, and a comparator for comparing the detected voltage and the transfer assuring voltage and generating an alarm when the detected voltage has become less than the transfer assuring voltage.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 14 is a diagram showing the construction of an exposure optical unit; and

FIGS. 15A and 15B are diagrams for describing transfer voltage in each of various states.

DESCRIPTION OF THE PREFERRED EMBODIMENT (1) Overview of the invention

Figure 1:
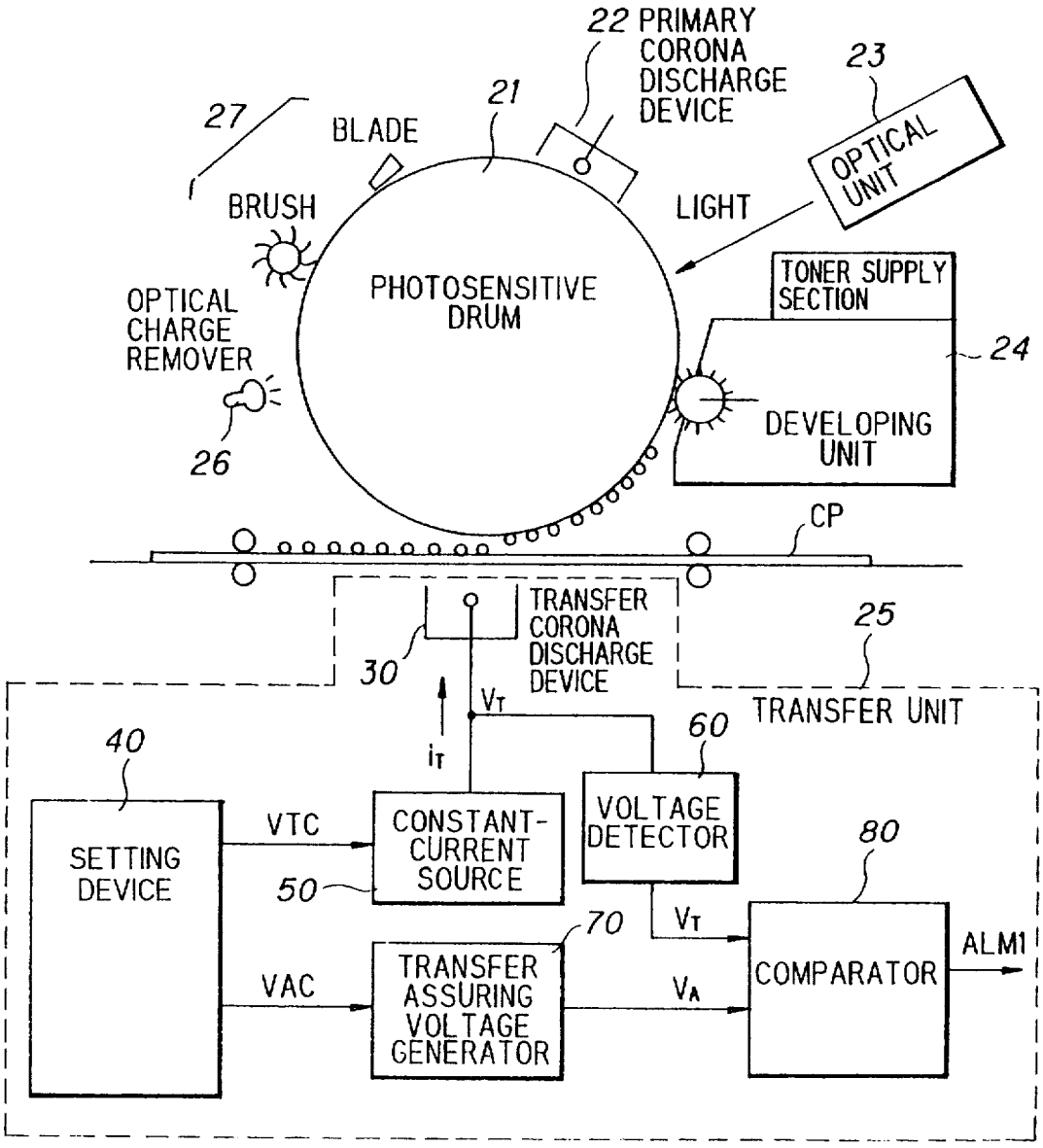
FIG. 1 is a diagram for describing the principles of the present invention.

FIG. 1 is a diagram for describing the general principles of the present invention.

Shown in FIG. 1 are a recording carrier (photosensitive drum) 21 in an electrophotographic printer, a primary corona discharge 22, an optical unit 23, a developing unit 24 for developing an electrostatic latent image into a toner image, a transfer unit 25, an optical charge removing device 26 and a cleaner 27.

The transfer unit 25 includes a transfer corona discharge device 30 for charging paper CP to a polarity opposite that of a charge on toner TN by corona discharge, a setting device 40 for setting a transfer voltage value VTC and a transfer assuring voltage value VAC which assures transfer, a constant-current source 50 for applying a transfer voltage $V_T$, which has a value conforming to the set transfer voltage value VTC, to the transfer corona discharge device 30 to supply the transfer corona discharge device with a constant current $i_T$, a voltage detector 60 for detecting the voltage $V_T$ applied to the transfer corona discharge device 30, a transfer assuring voltage generator 70 for outputting a transfer voltage $V_A$ conforming to the transfer assuring voltage value VAC, and a comparator 80 for comparing the detected voltage $V_T$ and the transfer assuring voltage $V_A$ and generating an alarm ALM1 when the detected voltage $V_T$ has become less than the transfer assuring voltage $V_A$.

When a transfer is to be performed, the setting device 40 sets the transfer voltage value VTC, which is that at which the best transfer would be obtained, as well as the transfer assuring voltage value VAC which assures transfer. The constant-current source 50 performs constant-current control in such a manner that the transfer voltage having the set value is applied to the transfer corona discharge device 30 so that the constant transfer current $I_T$ will flow. As a result, the transfer corona discharge device 30 charges the paper CP to a polarity opposite that of the electric charge of the toner TN by corona discharge, thereby transferring the toner image to the paper. The voltage detector 60 detects the voltage $V_T$ applied to the transfer corona discharge device 30, and the comparator 80 compares the detected voltage $V_T$ with the transfer assuring voltage $V_A$. If the detected voltage $V_T$ is less than the transfer assuring voltage $V_A$, then the comparator 80 takes this as meaning that transfer omission has occurred, as the result of a discharge abnormality such as leakage, and issues the alarm ALM1. Thus, by setting the transfer assuring voltage and performing monitoring to determine whether the voltage applied to the transfer corona discharge device has fallen below the transfer assuring voltage, discharge abnormality as caused by leakage, namely transfer omission, can be detected reliably, automatically and immediately.

Further, the setting device 40 is so adapted as to be capable of setting the transfer voltage VTC and transfer assuring voltage VAC to various values. For example, the setting device 40 can be so adapted as to store, in advance, transfer voltage values and transfer assuring voltage values in correlation with portions of the paper (the leading edge, middle, trailing edge, etc.) opposing the transfer corona discharge 30, detect the portion of the paper opposing the transfer corona discharge device 30 and set a transfer voltage value and a transfer assuring voltage value that conform to this portion of the paper. If this expedient is adopted, transfer can be performed at the optimum transfer capability in dependence upon the portion of the paper, and detection of transfer omission conforming to the transfer capability can be detected.

Furthermore, the comparator 80 is adapted to generate an alarm when the detected voltage VT falls below the transfer assuring voltage VA for more than a set period of time, with the this time period being variable in dependence upon recording speed (high/medium/low), by way of example. That is, even if the time of abnormal discharge is short, the higher the speed, the greater the influence upon transfer omission; hence, the set time is shortened. If this expedient is adopted, transfer-omission detection sensitivity can be altered based upon the printing speed or the like, thereby making it possible to detect transfer omission with assurance.

(b) Overview of transfer unit of the invention

Figure 2:
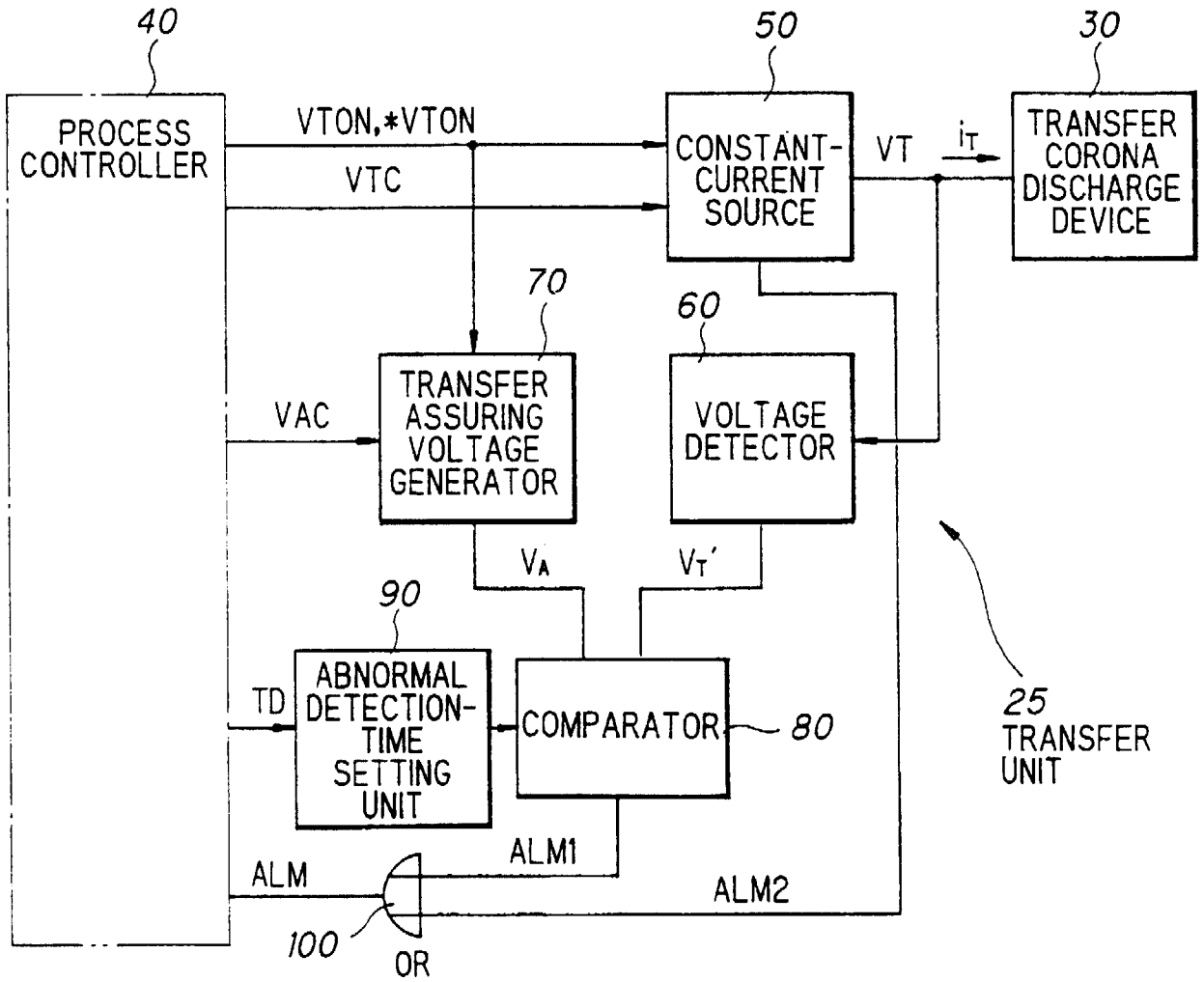
FIG. 2 is a simplified block diagram showing a transfer unit according to the present invention.

FIG. 2 is a block diagram illustrating the transfer unit 25 of the present invention. The transfer unit 25 includes the transfer corona discharge device 30 for charging printing paper to a polarity opposite that of the charge of a toner image by corona discharge, and a process controller 40 for controlling the overall process of the electrophotographic printer and setting the transfer voltage value VTC and the transfer assuring voltage value VAC which assures transfer. As for the setting of the transfer voltage value, VTC=1 is established if −5 KV is set; VTC=2 if −6 KV is set; and VTC=3 if −7 KV is set, by way of example. It should be noted that since the transfer voltage $V_T$ and transfer current $i_T$ are proportional, as will be discussed later, the transfer corona discharge device 30 can also set a transfer current value instead of the transfer voltage value.

The transfer unit 25 further includes the constant-current source 50 for applying the transfer voltage $V_T$, which has a value conforming to the set transfer voltage value VTC, to the transfer corona discharge device 30, and for supplying the transfer corona discharge device 30 with the constant current $i_T$, the voltage detector 60 for detecting the voltage $V_T$ applied to the transfer corona discharge device 30, the transfer assuring voltage generator 70 for generating the transfer assuring voltage $V_A$ conforming to the transfer assuring voltage value VAC that has been set, and the comparator 80 for comparing a detected voltage $V_T'$ and the transfer assuring voltage VA and generating the alarm ALM1 when the detected voltage has become less than the transfer assuring voltage. The constant-current source 50 is equipped with an overcurrent detecting circuit or overvoltage detecting circuit, not shown, and generates an alarm signal indicative of power-supply abnormality when the transfer voltage $V_T$ or transfer current $i_T$ exceeds the overvoltage value or overcurrent value, respectively. Numeral 90 denotes an abnormality detection-time setting unit, and numeral 100 represents an OR gate for outputting the OR of the alarm signals ALM1, ALM2 as an alarm signal ALM.

In keeping with the timing at which the leading edge of the recording paper arrives at the transfer corona discharge device 30, the process controller 40 sets the transfer voltage value VTC at which optimum transfer is obtained in the constant-current source 50 and sets the transfer assuring voltage value VAC which assures transfer in the transfer assuring voltage generator 70. The constant-current source 50 performs constant-current control in such a manner that the transfer voltage $V_T$ having the set value is applied to the transfer corona discharge 30 so that the constant transfer current $I_T$ will flow. As a result, the transfer corona discharge device 30 charges the recording paper to a polarity opposite that of the electric charge of the toner image by corona discharge, thereby transferring the toner image to the printing paper.

The voltage detector 60 detects the voltage $V_T$ applied to the transfer corona discharge device 30, and the transfer assuring voltage generator 70 outputs the transfer assuring voltage $V_A$ having the set value. The comparator 80 compares the detected voltage $V_T'$ and the transfer assuring voltage $V_A$. In a case where the detected voltage $V_T$ is greater than the transfer assuring voltage $V_A$, the comparator 80 judges that a discharge abnormality such as leakage has not occurred and that printing is being performed normally without transfer omission.

However, when a discharge abnormality such as leakage occurs, the impedance of the transfer corona discharge device 30 falls (the value of the current $i_T$ is constant). Consequently, the voltage $V_T$ applied to the transfer corona discharge device 30 decreases and the detected voltage $V_T'$ becomes smaller than the transfer assuring voltage $V_A$. In such case, the comparator 80 generates the alarm ALM1 upon judging that a discharge abnormality, i.e., transfer omission, has occurred. The alarm signal ALM1 is communicated to the process controller 40 via the OR gate 100. Upon receiving the alarm signal ALM, the process controller 40 halts printing and simultaneously notifies the host apparatus of the fact that an abnormality has occurred.

Figure 3:
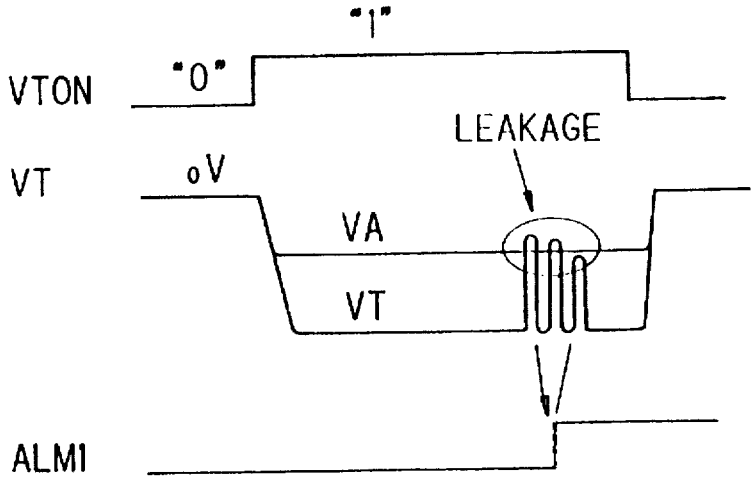
FIG. 3 is an alarm detection time chart (part 1)

FIG. 3 is a time chart of alarm detection. When a transfer voltage drive signal VTOn attains a high logic level, the constant-current source 50 applies the transfer voltage $V_T$ to the transfer corona discharge device 30. If leakage occurs under these conditions, the transfer voltage $V_T$ falls below the transfer assuring voltage $V_A$ (it is assumed hereinafter that such size relationships rely upon absolute values as a reference) and the comparator 80 outputs the alarm ALM1.

In the foregoing, the alarm signals ALM1, ALM2 are communicated to the process controller 40 via the 0R gate. However, these signals can also be communicated to the process controller 40 separately without the intermediary of the OR gate. Adopting such an arrangement makes it possible to distinguish between the transfer-omission alarm and the overcurrent (overvoltage) alarm. Further, if it is so decided that the transfer assuring voltage $V_A$ is 90% of the set transfer voltage, calculation from the transfer voltage value can be performed without it being necessary to set the transfer assuring voltage value VAC separately.

Figure 4:
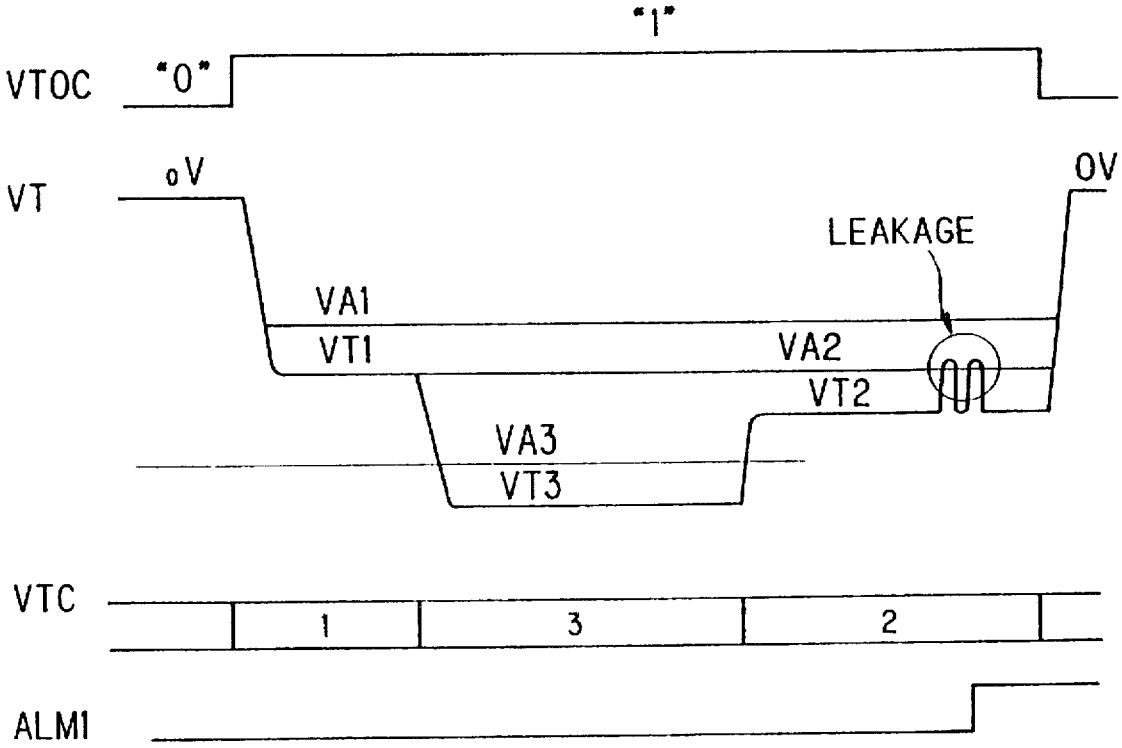
FIG. 4 is an alarm detection time chart (part 2)

The process controller 40 is so adapted that the transfer voltage and transfer assuring voltage can each be set to a variety of different values. For example, the transfer voltage value and transfer assuring voltage value are stored in a memory in advance in correlation with the portion of the paper (the leading edge, middle, trailing edge, etc.) opposing the transfer corona discharge 30, the portion of the paper opposing the transfer corona discharge device 30 is detected and the transfer voltage value and transfer assuring voltage value that conform to this portion of the paper are set. If this expedient is adopted, transfer can be performed at the optimum transfer capability in dependence upon the portion of the paper, and detection of transfer omission conforming to the transfer capability can be detected. FIG. 4 is a time chart of alarm detection in a case where three transfer voltage values VT1~VT3 and three transfer assuring voltage values VA1~VA3 are set in succession.

When the transfer voltage drive signal VTON attains the high level, the constant-current source 50 applies the transfer voltage $V_T$ (=VT1~VT3) conforming to the transfer voltage value VTC (=1~3) to the transfer corona discharge device 30. Further, the transfer assuring voltage generator 70 outputs the transfer assuring voltage $V_A$ (=VA1~VA3) conforming to the transfer assuring voltage value VAC. In such case, if leakage occurs in a state in which the transfer voltage $V_T$ (=VT2) conforming to VTC=2 is being applied to the transfer corona discharge device 30, the transfer voltage $V_T$ falls below the transfer assuring voltage $V_A$ (=VA2) and the comparator 80 outputs the alarm ALM1.

The comparator 80 generates the alarm when the detected voltage VT becomes smaller than the transfer assuring voltage VA in excess of a set period of time; this time can be set in a variable manner. That is, the process controller 40 inputs abnormality-detection set time data TD to the abnormality detection-time setting unit 90 at the same time that the transfer voltage value VTC and transfer assuring voltage value VAC are set. The set time is capable of being varied in dependence upon recording speed (high/medium/low), by way of example. The higher the speed, the shorter the set time for recognizing abnormality is made. The reason for this is that the higher the speed, the greater the influence upon transfer omission in abnormal discharge. The set time designated by the set time data TD is fed into the comparator 80 by the abnormality detection-time setting unit 90. When the detected voltage VT becomes smaller than the transfer assuring voltage VA in excess of the set time, the comparator 80 generates the alarm signal ALM1. By virtue of the above-described operation, the detection sensitivity of transfer omission can be altered based upon the printing speed or the like, and transfer omission can be detected in reliable fashion.

(c) Process controller

Figure 5:
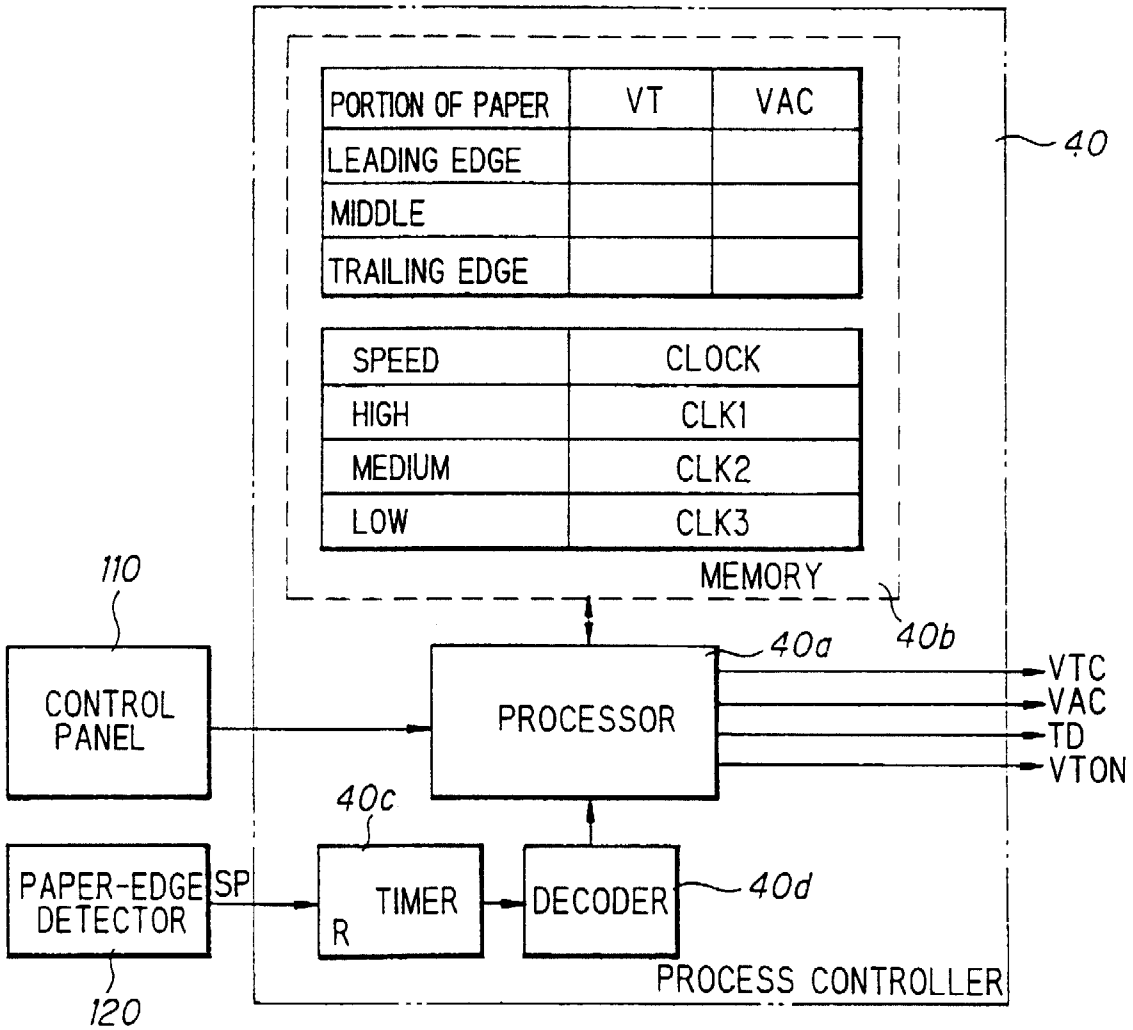
FIG. 5 is a diagram showing the principal components of a process controller.

FIG. 5 is a diagram illustrating the construction of the process controller in a case where the transfer voltage and transfer assuring voltage are set variably in dependence upon the portion of the paper opposing the transfer corona discharge device and the abnormality detection set time is made variable in dependence upon the recording speed (high/medium/low).

Shown in FIG. 5 are the process controller 40, a control panel 110 of a recording apparatus, and a paper leading-edge detector 120 provided on the side of the hopper of the transfer corona discharge device in the paper conveyance system. The detector 120 outputs a signal SP when it detects the leading edge of the printing paper. The process controller 40 includes a processor **40*a* and a memory 40*b* for storing the transfer voltage VT and transfer assuring voltage VAC conforming to the paper portion (leading edge, middle, trailing edge) opposing the transfer corona discharge device, as well as clocks (set times) CLK1~CLK3 conforming to the recording speed. The process controller 40 further includes a timer 40*c* for measuring elapsed time from detection of the leading edge of the paper, and a decoder 40*d* for decoding the elapsed time, thereby outputting a signal indicating the particular portion of the paper (leading edge, middle, trailing edge) situated at the transfer corona discharge device 30**.

The control panel 110 is operated in advance to store the transfer voltage VT and transfer assuring voltage VAC conforming to the portion of the paper (leading edge, middle, trailing edge) in the memory 40b as well as the clocks (set times) CLK1~CLK3 conforming to the recording speed. Also set beforehand using the control panel 110 is the distinction among the high/medium/low speeds of the recording apparatus.

If the leading edge of the paper is detected (SP="1") by the leading-edge detector 120 under these conditions, the timer 40c starts measuring elapsed time. When elapsed time attains a predetermined first time and the leading edge of the paper arrives at the transfer corona discharge device 30, the decoder 40d inputs the paper leading-edge signal to the processor 40a. The latter outputs the transfer voltage drive signal VTON, reads the transfer voltage VT and transfer assuring voltage VAC conforming to the leading edge of the paper out of the memory 40b, outputs these values and simultaneously outputs the specific clock data (set time data) TD conforming to the recording speed. As a result of the foregoing operation, generation of the transfer voltage and corona discharge are controlled and detection of transfer omission due to abnormal discharge is controlled as well.

If the paper is advanced, the elapsed time attains the second time and the middle of the recording paper arrives at the transfer corona discharge device, then the decoder inputs a signal indicative of the middle of the paper to the processor 40a. The latter reads the transfer voltage VT and transfer assuring voltage VAC conforming to the middle of the paper out of the memory 40b, outputs these voltages and executes control of transfer voltage generation, control of corona discharge and control of transfer-omission detection.

As the paper continues to be fed, the elapsed time attains the third time and the trailing edge of the recording paper arrives at the transfer corona discharge device, then the decoder inputs a signal indicative of the trailing edge of the paper to the processor 40a. The latter reads the transfer voltage VT and transfer assuring voltage VAC conforming to the trailing edge of the paper out of the memory 40b, outputs these voltages and then executes control of transfer voltage generation, control of corona discharge and control of transfer-omission detection. As the paper is fed further its trailing edge passes by transfer corona discharge device, at which timing the decoder 40d generates a signal indicative of this fact. In response to this signal, the processor 40a turns off the transfer voltage drive signal VTON and terminates this series of transfer control operations with respect to one sheet of the recording paper.

The foregoing is for a case in which one detector for detecting the printing paper is provided in front of the transfer corona discharge device. However, an arrangement may be adopted in which one paper detector is provided in front of the transfer corona discharge device and one in back so that the timing of both the start and end of transfer corona discharge can be determined.

(d) Transfer voltage and transfer assuring voltage

Figure 6:
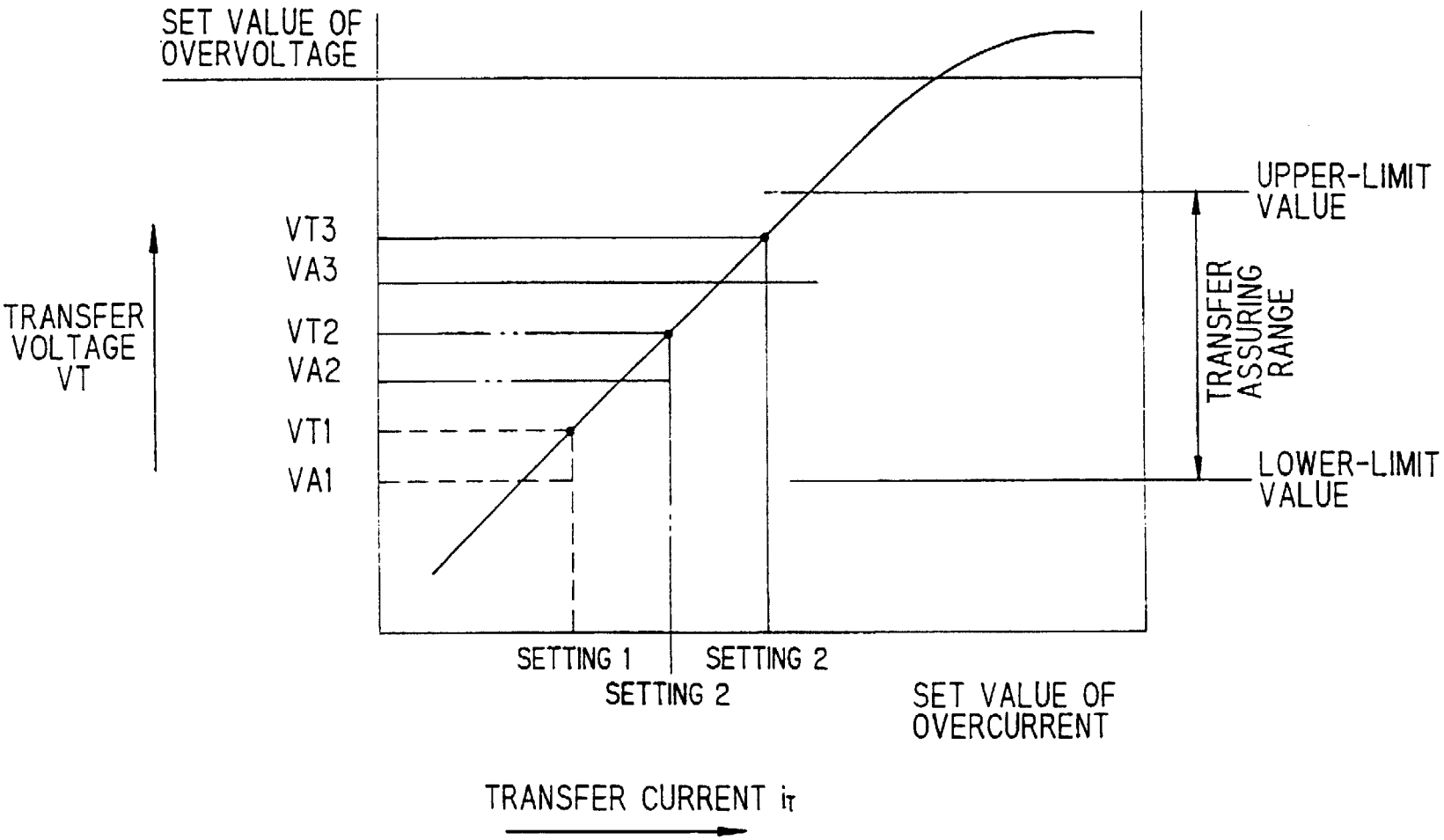
FIG. 6 is diagram showing a transfer current vs. transfer voltage characteristic.

FIG. 6 is a characteristic diagram showing the transfer current $i_T$ and transfer voltage $V_T$ of the transfer corona discharge device 30, as well as the transfer performance. The transfer current $i_T$ and transfer voltage $V_T$ of the transfer corona discharge device are proportionally related and offer a certain fixed load impedance $Z_N$. Above a certain value, however, the transfer voltage $V_T$ with respect to the transfer current $i_T$ saturates and the impedance changes. In terms of transfer performance, this rises with an increase in transfer current $i_T$, namely an increase in the transfer voltage $V_T$.

When the transfer current iT is increased, however, the force of attraction between the printing paper and the photosensitive drum grows larger and it becomes more difficult to separate the paper from the drum. Accordingly, the value at which separation problems are avoided is the upper-limit value of the transfer performance. The lower-limit value (the transfer assuring voltage VA) of the transfer voltage VT is set to a level at which printing density will fall slightly below that of the optimum level for transfer to the printing paper, but at which printing will still be legible. The optimum level varies depending upon the transfer position (leading edge, middle, trailing edge) of the printing paper, whether the printed surface is the front or back of the paper, the paper material, etc. For example, the transfer voltages are as indicated at VT1~VT3 in FIG. 6, and the transfer assuring voltage varies in the manner of VA1~VA3 in dependence upon the optimum level. It should be noted that the set values of overcurrent and overvoltage have been set to values higher than the upper-limit value of transfer performance.

(e) Abnormal detection time

The pulse width of abnormal voltage at the time of leakage is not constant, and the influence of leakage pulse width in a low-speed recording apparatus differs from that in a high-speed recording apparatus. Transfer omission occurs in a high-speed machine in a time in which it does not occur in a low-speed machine. Accordingly, the higher the machine speed, the more sensitivity must be increased to enable detection of a short leakage width, thereby assuring reliable detection of transfer omission. In case of a short leakage time, on the other hand, transfer omission does not occur in a low-speed machine even though it occurs in a high-speed machine. Accordingly, the lower the machine speed, the more sensitivity must be reduced so as to detect only comparatively leakage width, thereby assuring detection of transfer omission. Abnormal detection time (leakage width) in high-speed/medium-speed/low-speed machines should be determined experimentally. By way of example, the values in high-, medium- and low-speed machines are 5~10 ms, 20~30 ms and 30~50 ms, respectively.

(f) Detailed construction of transfer unit

Figure 7:
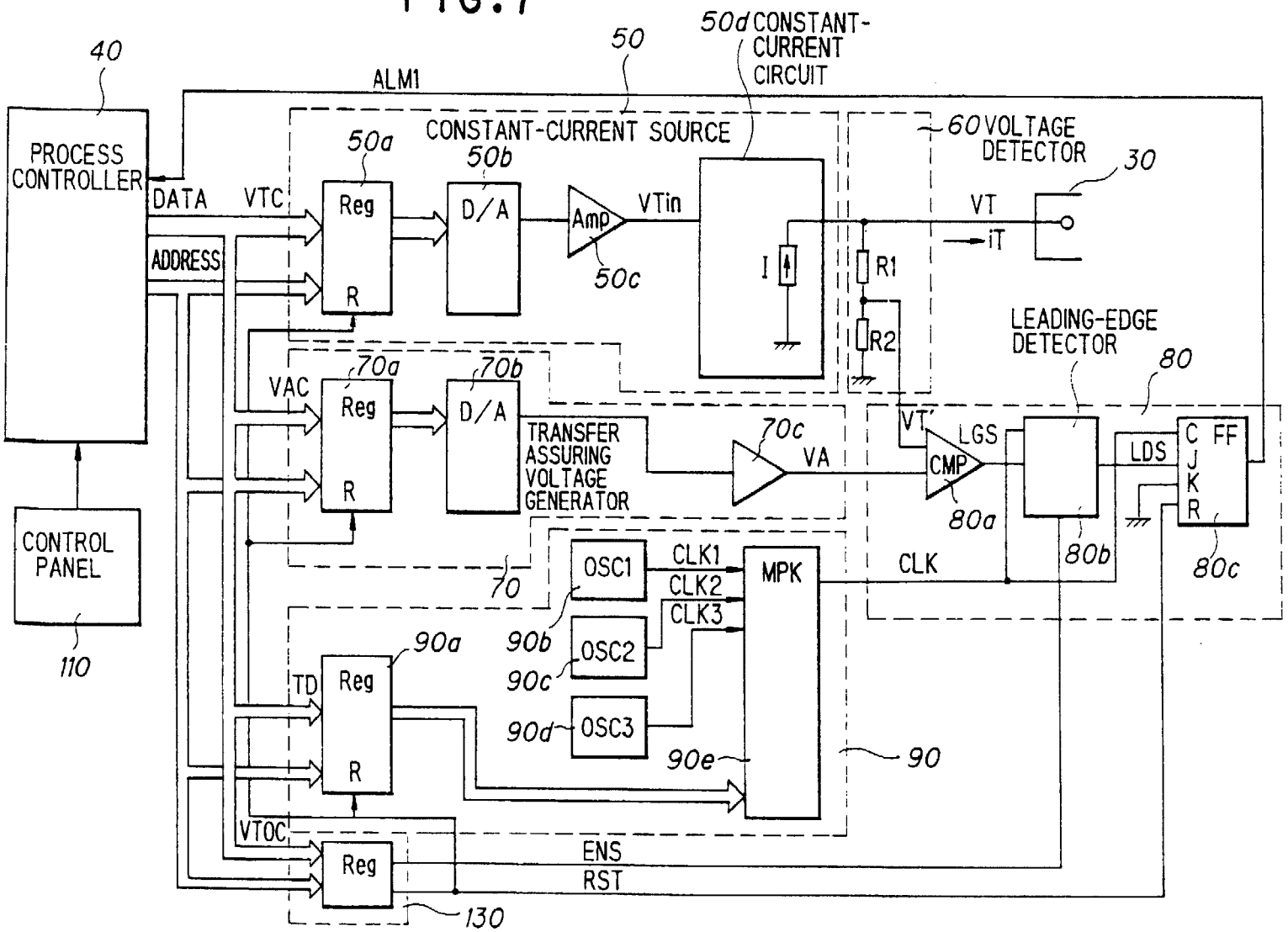
FIG. 7 is a detailed block diagram showing the transfer unit of the present invention.

FIG. 7 is a detailed block diagram showing the transfer unit of the present invention, in which components identical with those of FIG. 2 are designated by like reference characters.

Shown in FIG. 7 are the transfer corona discharge device 30, the process controller 40 which, in keeping with the timing at which the printing paper arrives at the transfer corona discharge device 30, outputs the transfer voltage value VTC, the transfer assuring voltage value VAC, the abnormal detection-time data TD and the transfer voltage drive command VTON, the constant-current source 50, the voltage detector 60, the transfer assuring voltage generator 70, the comparator 80, the abnormality detection-time setting unit 90, the control panel 110 and an enable/reset signal generator 130.

The constant-current source 50 has a register 50a for storing the set transfer voltage value VTC from the process controller 40, a DA converter 50b for converting the transfer voltage value VTC into an analog value, an amplifier 50c for amplifying the analog output of the DA converter 50b, and a constant-current circuit (high-voltage generator) 50d for applying the transfer voltage $V_T$ to the transfer corona discharge device 30 to supply the constant current $i_T$. The voltage detector 60 potential-divides the output voltage (the applied voltage of the transfer corona discharge device) $V_T$ of the constant-current circuit 50d by resistors $R_1$, $R_2$ and applies the result to the comparator 80.

The transfer assuring voltage generator 70 has a register 70a for storing the set transfer assuring voltage value VAC from the process controller 40, a DA converter 70*b* for converting the transfer assuring voltage value VAC into an analog value, and an amplifier 70*c* for amplifying the analog output of the DA converter 70*b*.

The comparator 80 has a comparator element (CMP) 80*a*, a leading-edge detector 80*b* and a J-K flip-flop 80*c*. The comparator element 80*a* compares the detected voltage VT' and the transfer assuring voltage VA and outputs a signal LGS which attains the high level when $V_T' < V_A$ holds. The signal LGS indicates that leakage has occurred. When the signal LGS attains the high level, the leading-edge detector 80*b* sends a leakage-detection signal LDS to the high level in synch with a clock signal CLK. When the next clock signal CLK is generated, or when the leak signal LGS falls to the low level, the detector 80*b* sends the leak-detection signal LDS to the low level. The flip-flop 80*c* is set by the clock signal CLK when the leak-detection signal LDS is at the high level, thereby outputting the alarm signal ALM1.

The abnormality detection-time setting unit 90 includes a register 90*a* for storing the set specific clock data (set time data) TD from the process controller 24, first~third clock signal generators 90*b* ~90*d* and a multiplexer (MPX) 90*e* for selecting and outputting a prescribed clock signal. The first, second and third clock signal generators 90*b*, 90*c* and 90*d* output a first clock signal CLK1 having a period of 5~10 msec, a second clock signal CLK2 having a period of 20~30 msec and a third clock signal CLK3 having a period of 30~50 msec, respectively. The set specific clock data (set time data) TD from the process controller 40 becomes TD=1 to select the first clock signal CLK1 in case of high-speed recording, TD=2 to select the second clock signal CLK2 in case of medium-speed recording and TD=3 to select the third clock signal CLK3 in case of low-speed recording.

In the case of the high-speed clock signal, even if abnormal discharge (leakage) time is short and the signal LGS indicative of occurrence of leakage is at the high level for a short time, the flip-flop 80*c* is set and the alarm signal ALM1 can be outputted. However, in the case of the low-speed clock signal, the flip-flop 80*c* cannot be set and the alarm ALM1 is not issued when the abnormal discharge (leakage) time is short.

The enable/reset signal generator 130 outputs the enable signal ENS in response to the transfer voltage drive command VTON, and the leading-edge detector 80*b* of the comparator 80 is capable of detecting discharge abnormality (transfer omission) in response to the enable signal. Further, the enable/reset signal generator 130 outputs a reset signal RST for the duration of one clock in response to a transfer voltage drive-stop command *VTON, thereby resetting the contents of the register 50*a* of the constant-current source 50, the register 70*a* of the transfer assuring voltage generator 70, the register 90*a* of the abnormality detection-time setting unit 90 and the flip-flop 80*c*.

(g) Construction of constant-current circuit

Figure 8:
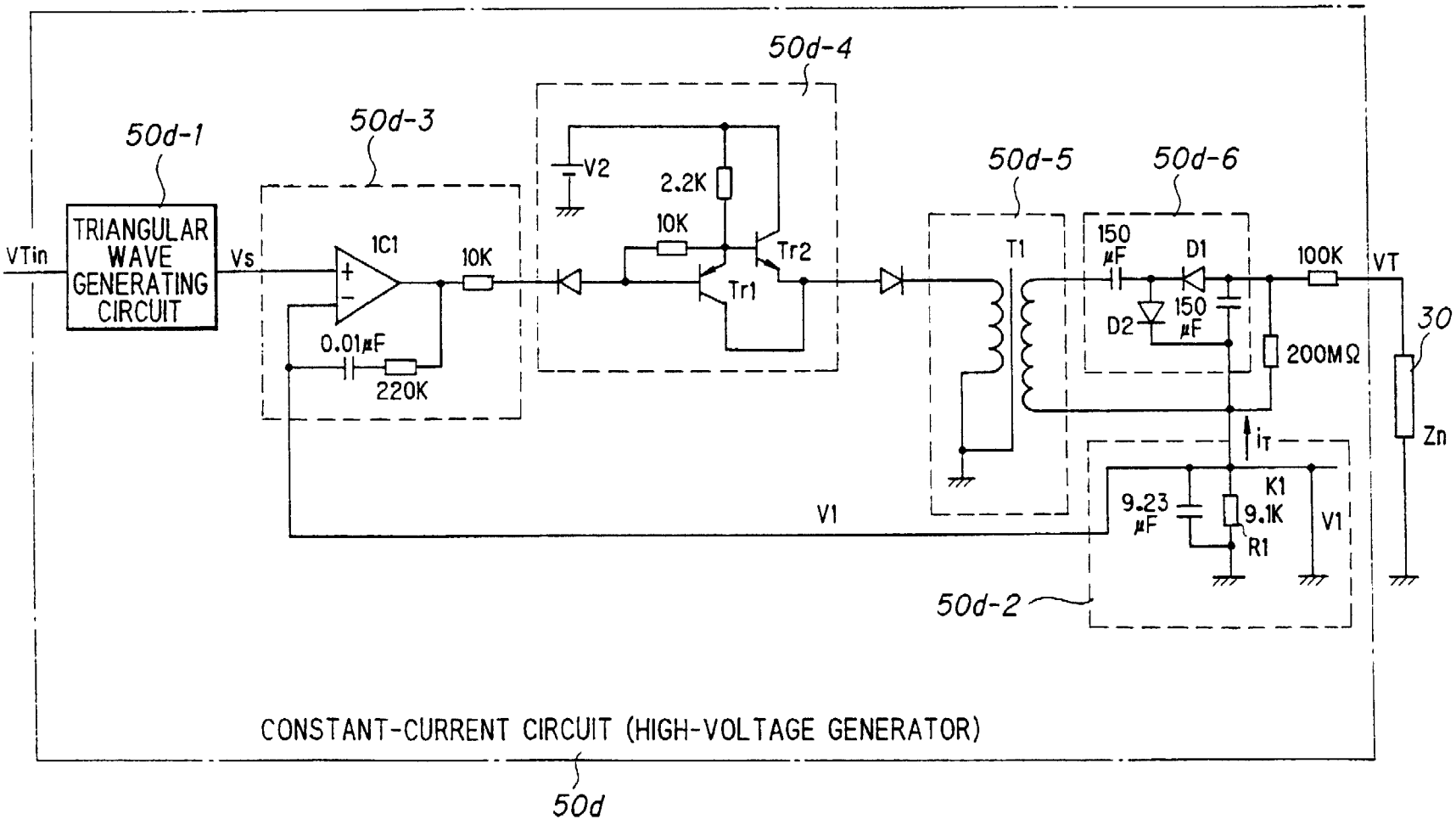
FIG. 8 is a diagram showing a constant-current circuit.

FIG. 8 is a diagram showing the construction of the constant-current circuit (high-voltage generator) in the constant-current source. Numeral 30 denotes transfer corona discharge device, which is the load, and number 50*d* denotes the constant-current circuit.

The constant-current circuit 50*d* includes a triangular-wave generating circuit 50*d*-1 for generating a triangular voltage signal VS having an amplitude conforming to a commanded transfer voltage VTin, a transfer current detector 50*d*-2 for detecting the transfer current $i_T$ that flows into the transfer corona discharge device 30, a voltage comparator 50*d*-3 having a comparator element for comparing the magnitudes of the triangular voltage signal VS and a terminal voltage V1 ($=i_T$·R1) of a resistor R1 in which the transfer current $i_T$ flows, a switching section 50*d*-4 for chopping and DC-AC converting a DC voltage V2 in dependence upon the magnitudes of the triangular voltage signal VS and terminal voltage V1, a transformer 50*d*-5 whose primary side is provided with the AC signal resulting from the DC-AC conversion performed by the switching section, and a rectifier 50*d*-6, which is composed of diodes, for rectifying the output from the secondary side of the transformer 50*d*-5.

Figure 9:
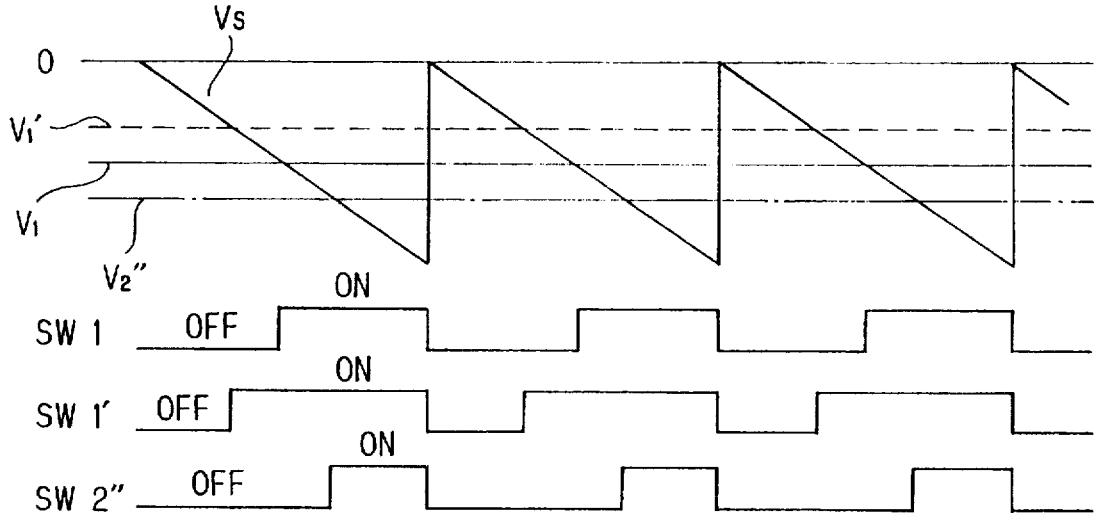
FIG. 9 is a waveform diagram (part 1) for describing the operation of the constant-current circuit.

The switching section 50*d*-4 is turned on if VS>V1 holds and is turned off if VS<V1 holds. Accordingly, when the transfer current $i_T$ is equal to a constant current value I and the terminal voltage V1 maintains the level of the solid line in FIG. 9, the switching section 50*d*-4 is turned on/off at the duty indicated at SW1. When the transfer current iT falls below the constant current value I and the terminal voltage V1' declines under these conditions (see the dashed line), the time during which the switching section 50*d*-4 turns on is prolonged, as indicated at SW1', and the output on the secondary side of the transformer 50*d*-5 increases. As a result, V1 increases and the transfer current $i_T$ increases and becomes equal to the constant current I.

Conversely, when the transfer current $i_T$ increases and surpasses the constant current value I, the terminal voltage V1 increases (see the one-dot chain line), the time during which the switching section 50*d*-4 is on is shortened, as indicated at SW1", and the secondary output of the transformer 50*d*-5 decreases. As a result, V1 decreases and the transfer current $i_T$ decreases and becomes equal to the constant value I.

Figure 10:
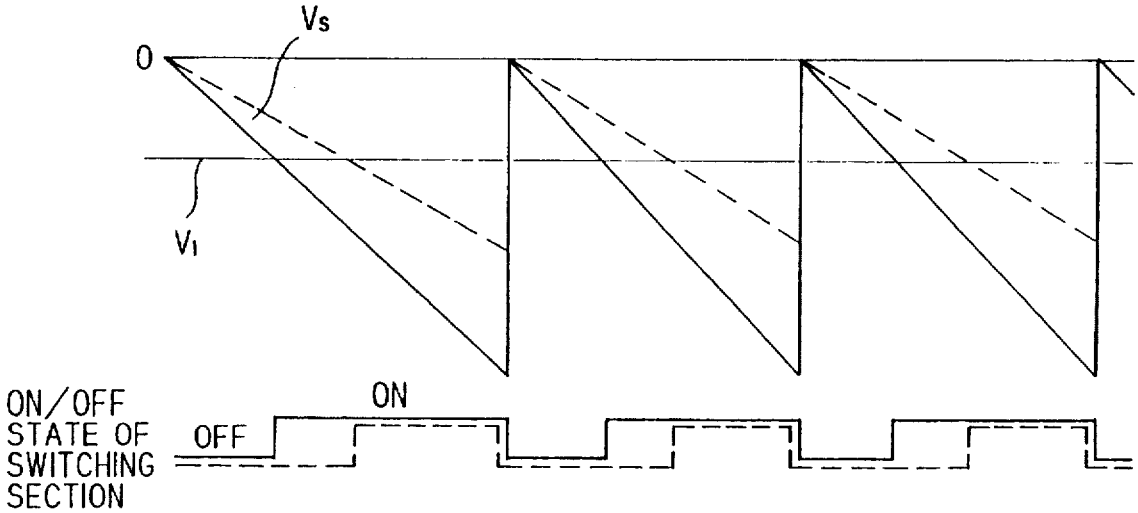
FIG. 10 is a waveform diagram (part 2) for describing the operation of the constant-current circuit.

When the commanded transfer voltage value VTin increases, the amplitude of the triangular voltage signal VS increases and the time during which the switching section 50*d*-4 is on lengthens in comparison with the case in which the amplitude is small, as shown in FIG. 10 (see the dashed line). As a result, the transfer current $i_T$ increases and the transfer performance is improved.

(b) Overall operation

Figure 11:
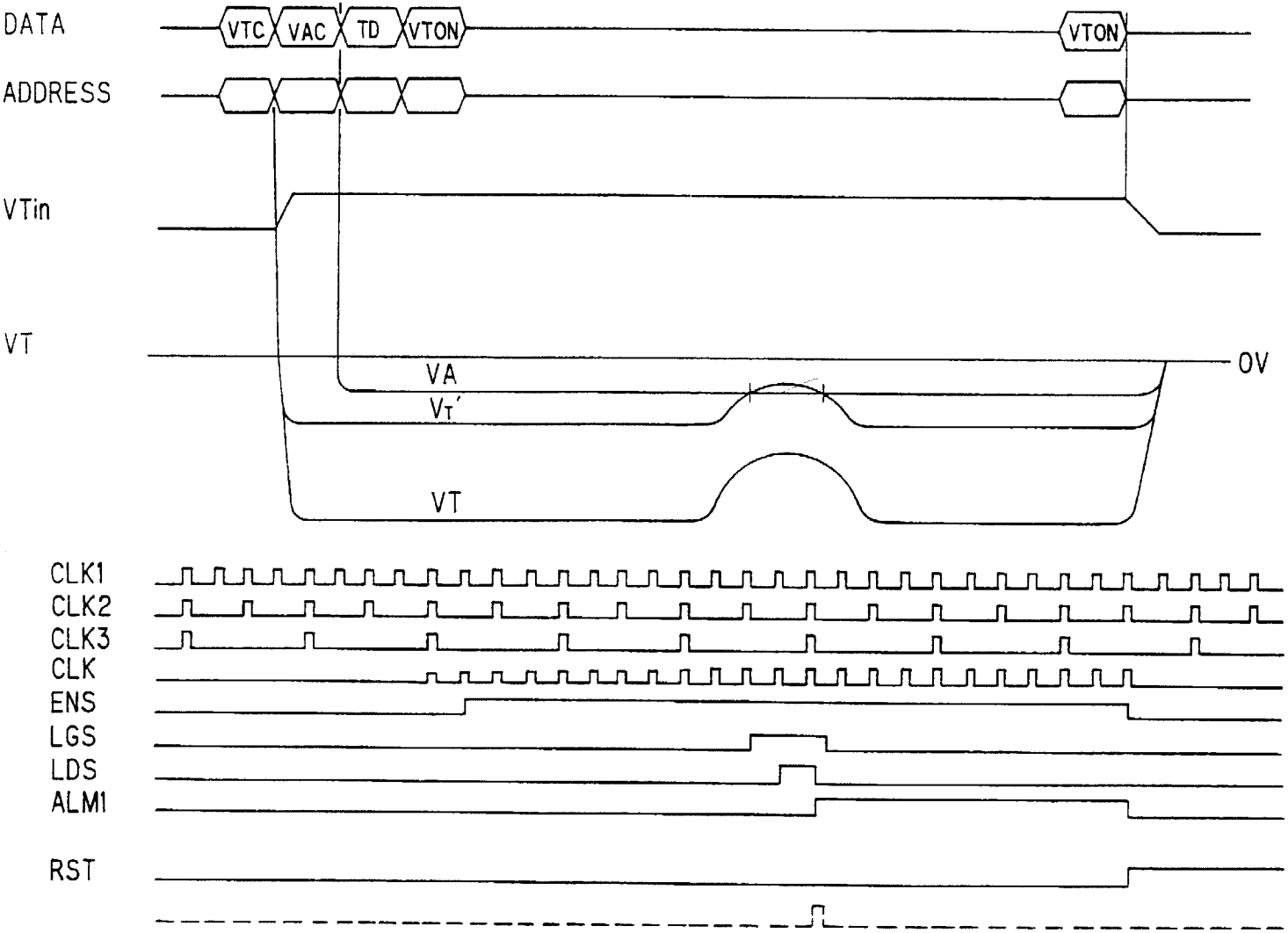
FIG. 11 is a time chart for describing the operation of the transfer unit.

FIG. 11 is a waveform diagram for describing the operation of the transfer unit illustrated in FIG. 7.

In keeping with the timing at which the leading edge of the printing paper arrives at the transfer corona discharge device 30, the process controller 40 successively outputs the transfer voltage value VTC, the transfer assuring voltage value VAC, the specific clock data (set time data) TD and the transfer voltage drive command VTON and sets these values in the register 50*a* of the constant-current source 50, the register 70*a of the transfer assuring voltage generator 70, the register 90a* of the abnormality detection-time setting unit 90 and the enable/reset signal generator 130.

Owing to setting of the transfer voltage value VTC, the constant-current source 50 applies the transfer voltage VT having the set value to the transfer corona discharge device 30 and performs constant-current control in such a manner that the constant transfer current $i_T$ will flow. As a result, it is possible for the transfer corona discharge device 30 to charge the recording paper to a charge opposite that of the toner image.

The voltage detector 60 potential-divides the voltage VT applied to the transfer corona discharge device 30 and inputs the result to the comparator 80, and the transfer assuring voltage generator 70 generates the transfer assuring voltage VA having the set value and inputs this value to the comparator 80.

The register 90*a* of the abnormality detection-time setting unit 90 selects a clock signal (e.g., the first clock signal CLK1) designated by the specific clock data TD and inputs this clock signal to the comparator 80 as the clock signal CLK.

The comparator 80 compares the detected voltage $V_T'$ and the transfer assuring voltage $V_A$. If the detected voltage $V_T'$ is greater than the transfer assuring voltage $V_A$, the comparator judges that a discharge abnormality such as leakage will not occur and that normal printing is taking place without transfer omission.

However, if the detected voltage $V_T'$ decreases and the transfer assuring voltage $V_A$ declines owing to a discharge abnormality such as leakage, the comparator element 80*a* of the comparator 80 outputs the high-level signal LGS indicative of the occurrence of leakage. When the signal LGS has attained the high level, the leading edge detector 80*b* sends the leakage-detection signal LDS to the high level in synch with a clock signal CLK. When the next clock signal CLK is generated, or when the leak signal LGS falls to the low level, the detector 80*b* sends the leak-detection signal LDS to the low level. In the example of FIG. 11, the signal LGS indicative of occurrence of leakage is at the high level until the next clock signal CLK is generated, and therefore the flip-flop 80*c* is set by the clock signal and outputs the alarm signal ALM1 to the process controller 40. When the alarm signal ALM is generated, the process controller 40 halts printing and simultaneously notifies the host apparatus of the occurrence of an abnormality.

The foregoing is for a case in which the high-speed clock signal CLK1 has been selected as the clock signal CLK. In a case where the low-speed clock-signals CLK2, CLK3 are selected as the clock signal CLK, the signal LGS indicative of occurrence of leakage falls to the low level before the next clock signal CLK is generated; hence, a discharge abnormality is not detected and an alarm is not issued. In other words, the higher the speed of the clock signal, the higher the sensitivity of transfer-omission detection is made.

(i) Image forming apparatus using transfer unit of the invention

Figure 12:
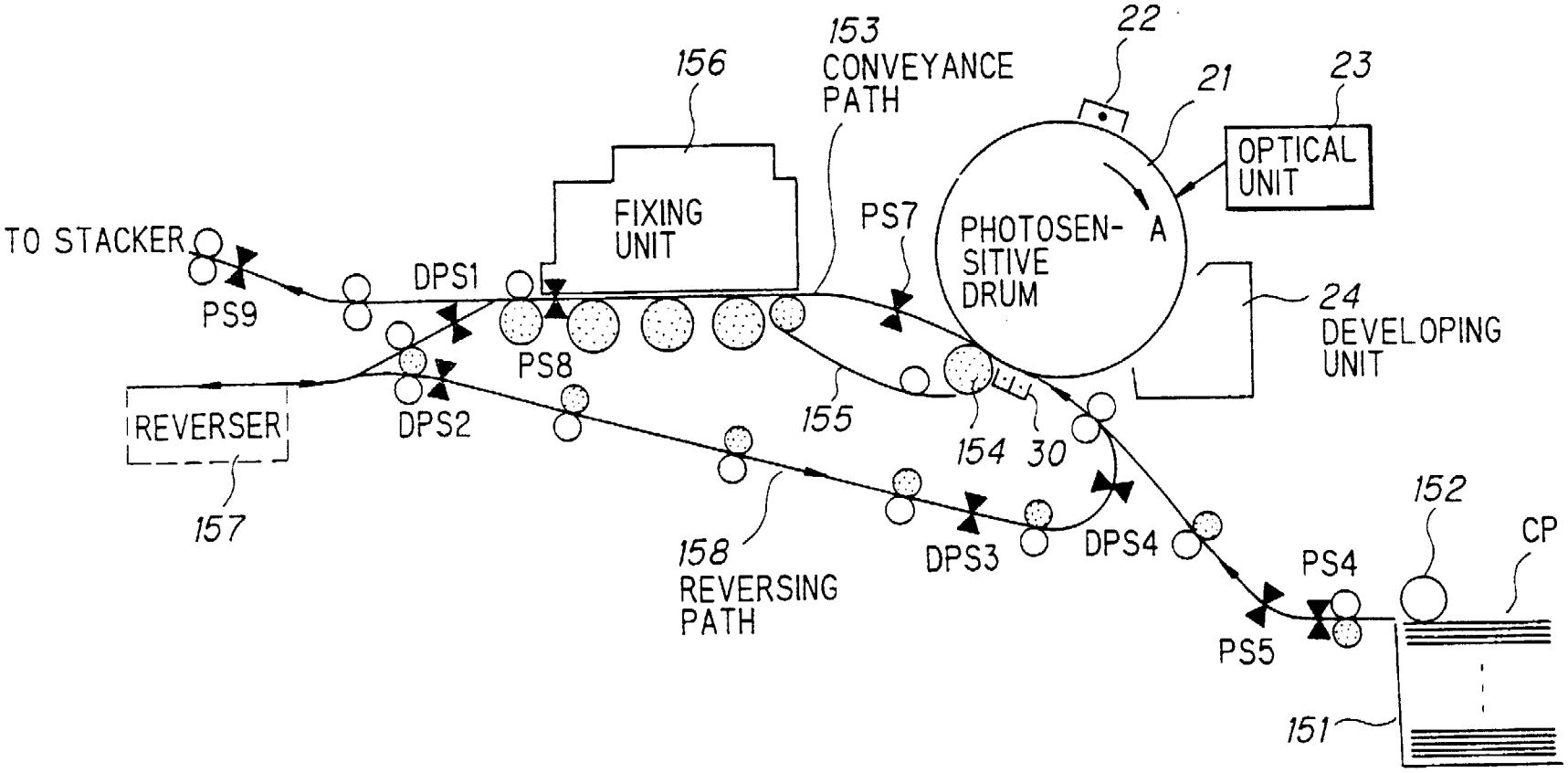
FIG. 12 is a diagram showing the construction of an image forming apparatus using the transfer unit of the present invention.
Figure 13:
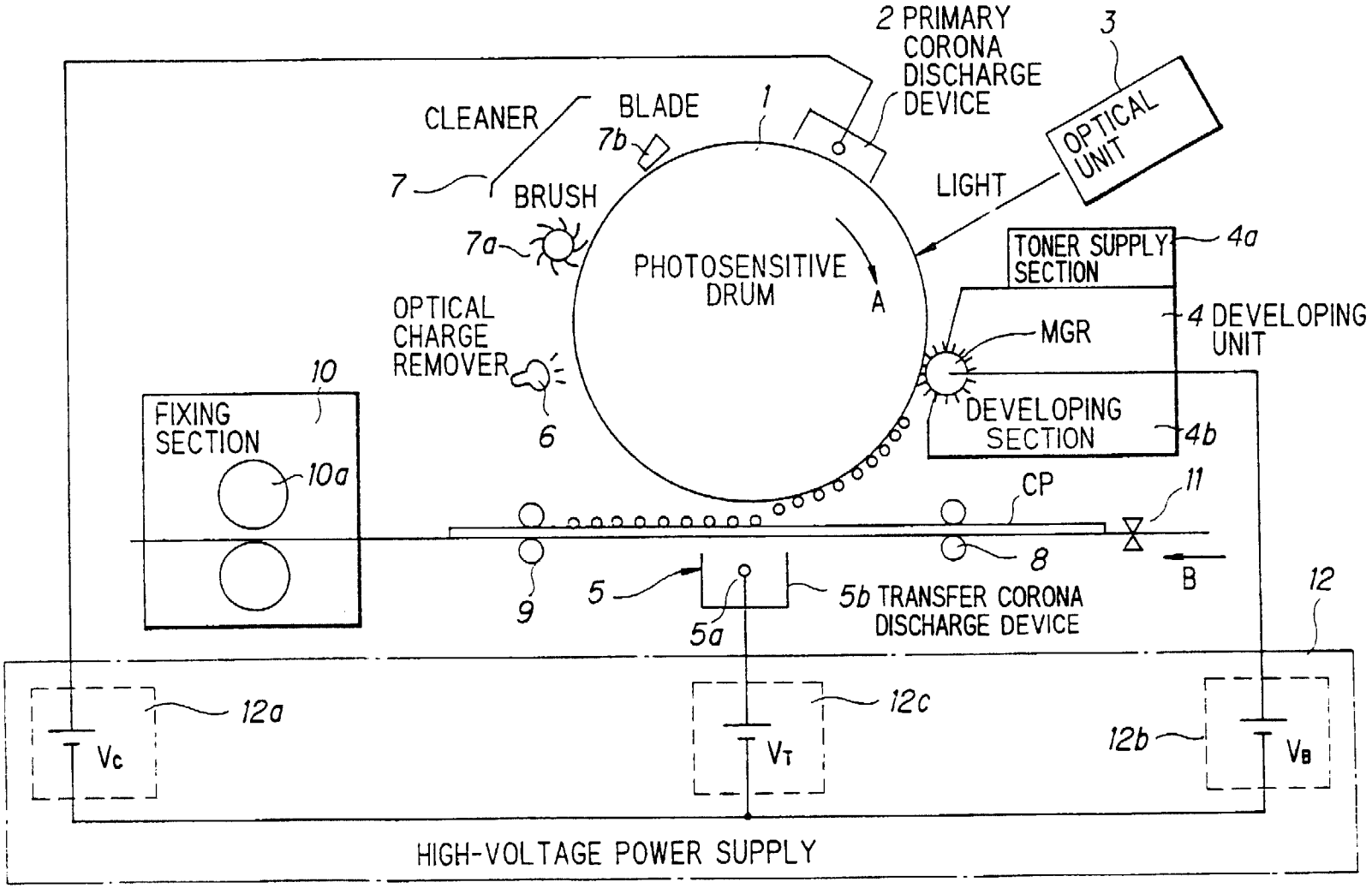
FIG. 13 (PRIOR ART)
FIG. 13 is a diagram showing the overall construction of an electrophotographic printer.

FIG. 12 is a diagram showing the construction of an image forming apparatus using the transfer unit of the present invention.

Shown in FIG. 1 are the photosensitive drum 21 having a photoconductor (photoreceptor) on the surface thereof. The drum 21 is rotated in the direction of arrow A at a constant speed. The apparatus further includes the primary corona discharge device 22 for uniformly charging the surface of the photosensitive drum 21, the exposure optical unit 23 for irradiating the photosensitive drum 21 with an optical image to form an electrostatic latent image, the developing unit 24 for forming a toner image corresponding to the electrostatic latent image, and the transfer corona discharge device 30 for transferring the toner image to printing paper CP. The device 30 constitutes the transfer unit of FIG. 2. Provided along the periphery of the photosensitive drum 21, though not shown, are such components as a charge remover for removing electric charge from the photosensitive drum, and a cleaner for removing and wiping off toner remaining on the photosensitive drum.

When the optical image is projected upon the surface of the photosensitive drum 21 uniformly charged to a positive charge, for example, by the primary corona discharge device 22, the potential at portions upon which the light is incident drops so that an electrostatic latent image is formed. Next, a toner image is formed by developing the latent image in the developing unit 24 using toner. If the transfer corona discharge device 30 subsequently generates a corona discharge from the bottom side of the paper CP at a potential whose polarity (minus) is opposite the potential to which the toner image has been charged, the paper is charged negatively. As a result, the toner image is attracted to the paper CP and transferred thereto. After the toner image is transferred to the paper, the photosensitive drum 21 is rotated further, charge is removed by the optical charge removing device and residual toner is removed by the cleaner to prepare for formation of the next electrostatic latent image.

A hopper 151 accommodates a large number of sheets of the paper CP cut to a predetermined size and already printed upon. Since the cut paper CP is brushed using an electrically conductive brush at the time of manufacture in order to remove paper dust, fibers from the brush may fall out and become lodged between the paper sheets. A pick-up blower 152 picks up sheets from the hopper 151 and delivers them one sheet at a time. The paper delivered from the hopper is transferred in the direction of the photosensitive drum and stacker by a transfer path 153. An attraction roller 154 is for separating the paper from the photosensitive drum 21. Specifically, air is drawn in by a blower (not shown) so that the paper attracted to the photosensitive drum 21 is separated from the drum. Numeral 155 denotes a conveyor belt, 156 a flash fixing device (fixing unit) for fixing the toner image on the paper, 157 a reverser for reversing the direction of movement of the paper in order to print on its back side, 158 a reversing path for reversing the path of the paper between the photosensitive drum 21 and hopper 151 in order to return the paper, PS4~PS9 paper detectors provided in the conveyance path 153, and DPS1~DPS4 paper detectors provided in the paper reversal path.

The paper is delivered from the hopper 151, conveyed along the conveyance path 153 and reaches the transfer section (transfer corona discharge device) 30, where the toner image on the photosensitive drum 21 is transferred. Next, the paper is separated from the drum by the attracting roller 154 and conveyed to the fixing unit 156 by the conveyor belt 155, and the toner image is fixed by the fixing unit 156.

In case of single-side printing, the paper is conveyed to the stacker as is. In double-side printing, however, the paper is fed to the reverser 157, where the direction in which the paper travels is reversed. The paper is conveyed along the reverse path 158, turned over and transferred to the conveyance path 153. Thereafter, the toner image on the photosensitive drum is transferred to the back side of the paper by the transfer corona discharge device 30, the toner image is fixed by the fixing unit and the paper is then conveyed to the stacker.

It should be noted that timing for starting and ending projection of the optical image by the optical unit 23 and timing for starting and stopping the corona discharge performed by the transfer corona discharge device 30 is controlled by a controller (not shown) using as a reference the time at which the paper is detected by the paper detectors PS5, DPS4. This assures that the paper will be printed on correctly.

In accordance with the present invention, as described above, when a constant-current source is used as the power supply of a transfer corona discharge device, a transfer assuring voltage is set and monitoring is performed to determine whether voltage applied to the transfer corona discharge device has fallen below the transfer assuring voltage. As a result, discharge abnormality as caused by leakage, namely transfer omission, can be detected reliably, automatically and immediately.

Further, according to the present invention, it is so arranged that the transfer voltage value and transfer assuring voltage value can be set to various values in a variable manner. Accordingly, transfer can be performed at the optimum transfer performance in dependence upon the portion of the paper, for example, and transfer omission conforming to transfer performance can be detected.

Furthermore, in accordance with the present invention, it is so arranged that an alarm is generated when detected voltage falls below the transfer assuring voltage for more than a set period of time, and it is so arranged that this time can be set in variable fashion. Accordingly, transfer-omission detection sensitivity can be altered by changing the set time in dependence upon the recording speed (high/medium/low), thereby making it possible to detect transfer omission with assurance.

As many apparently widely different embodiments of the present invention can be made without departing from the spirit and scope thereof, it is to be understood that the invention is not limited to the specific embodiments thereof except as defined in the appended claims.

What is claimed is:

1. A transfer unit for forming an image on a recording carrier by a transfer material, charging a transfer medium to a polarity opposite that of a charge on the transfer material by a corona discharge and transferring the transfer material to the transfer medium, comprising:

a transfer corona discharge device for generating a corona discharge;

a setting device for setting one of a transfer voltage and transfer current and a transfer assuring voltage for assuring transfer, the transfer assuring voltage being lower than the transfer voltage;

a high-voltage generator including a constant-current source, for applying a transfer voltage, which has a value conforming to the set transfer voltage or transfer current, to said transfer corona discharge device;

a voltage detector for detecting the voltage applied to said transfer corona discharge device; and a comparator for comparing the detected voltage and the transfer assuring voltage, said comparing determining, in order to avoid a transfer omission, whether or not the transfer voltage applied to the transfer corona discharge device is lowered and generating an alarm when the detected voltage has become less than the transfer assuring voltage.

2. The transfer unit according to claim 1, wherein said setting device has means for setting the transfer voltage or transfer current and the transfer assuring voltage in a variable manner.

3. The transfer unit according to claim 2, wherein said setting device has memory means for storing the transfer voltage or transfer current and the transfer assuring voltage in correlation with each portion of the transfer medium and said setting device sets the transfer voltage or transfer current and the transfer assuring voltage conforming to a portion of the transfer medium that opposes the transfer corona discharge device.

4. The transfer unit according to claim 1, wherein said comparator generates an alarm when the detected voltage becomes smaller than the transfer assuring voltage for more than a prescribed period of time.

5. The transfer unit according to claim 4, wherein said setting device has means for setting said time in a variable manner in dependence upon recording speed.

6. An image forming apparatus for forming a toner image on a photosensitive drum, charging a cut sheet of paper to a polarity opposite that of a charge on the toner image by a corona discharge and transferring said toner image to the cut sheet of paper, comprising:

a preliminary corona discharge device for uniformly charging a surface of a photosensitive drum;

an optical unit for projecting an optical image upon said photosensitive drum and forming an electrostatic latent image;

a developing unit for forming a toner image corresponding to the electrostatic latent image; and a transfer unit for transferring the toner image to a cut sheet of paper;

said transfer unit including:

a transfer corona discharge device for generating a corona discharge;

a setting device for setting one of a transfer voltage and transfer current and a transfer assuring voltage for assuring transfer, the transfer assuring voltage being lower than the transfer voltage;

a high-voltage generator, including a constant-current source, for applying a transfer voltage, which has a value conforming to the set transfer voltage or transfer current, to said transfer corona discharge device;

a voltage detector for detecting the voltage applied to said transfer corona discharge device; and a comparator for comparing the detected voltage and the transfer assuring voltage, said comparing determining, in order to avoid a transfer omission, whether or not the transfer voltage applied to the transfer corona discharge device is lowered and generating an alarm when the detected voltage has become less than the transfer assuring voltage.

* * * * *